US010294437B2

(12) United States Patent
Hopkins et al.

(10) Patent No.: US 10,294,437 B2
(45) Date of Patent: May 21, 2019

(54) ADDITIVE COMPOSITIONS AND TO FUEL OILS

(71) Applicant: Infineum International Limited, Abingdon (GB)

(72) Inventors: Sally A. Hopkins, Stanford in the Vale (GB); Dhanesh G. Goberdhan, Oxford (GB); Giles W. Theaker, Abingdon (GB)

(73) Assignee: INFINEUM INTERNATIONAL LIMITED, Abingdon, Oxfordshire (GB)

( * ) Notice: Subject to any disclaimer, the term of this patent is extended or adjusted under 35 U.S.C. 154(b) by 0 days.

(21) Appl. No.: 15/153,782

(22) Filed: May 13, 2016

(65) Prior Publication Data

US 2016/0333282 A1 Nov. 17, 2016

(30) Foreign Application Priority Data

May 14, 2015 (EP) ..... 15167746

(51) Int. Cl.

| | |
|---|---|
| ***C10L 1/18*** | (2006.01) |
| ***C10L 1/192*** | (2006.01) |
| *C10L 1/196* | (2006.01) |
| *C10L 1/198* | (2006.01) |
| *C10L 1/183* | (2006.01) |
| *C10L 1/197* | (2006.01) |

(52) U.S. Cl.

CPC ..... *C10L 1/18* (2013.01); *C10L 1/192* (2013.01); *C10L 1/1835* (2013.01); *C10L 1/1963* (2013.01); *C10L 1/1976* (2013.01); *C10L 1/1981* (2013.01); *C10L 2230/20* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,409,778 | B1 * | 6/2002 | Auschra | C08F 220/18 44/388 |
| 2005/0039384 | A1 * | 2/2005 | Gormley | C10L 1/1963 44/397 |
| 2007/0027040 | A1 | 2/2007 | Krull et al. | |
| 2008/0141582 | A1 | 6/2008 | Breakspear | |
| 2010/0072427 | A1 * | 3/2010 | Posselt | C08G 75/22 252/500 |
| 2012/0149617 | A1 * | 6/2012 | Lange | C07D 265/16 508/248 |

FOREIGN PATENT DOCUMENTS

| | | | |
|---|---|---|---|
| EP | 1640438 | A1 | 3/2006 |
| EP | 1752513 | A2 | 2/2007 |
| GB | 1384536 | A | 2/1975 |
| WO | WO-9927037 | A1 | 6/1999 |

* cited by examiner

*Primary Examiner* — Ellen M McAvoy
*Assistant Examiner* — Chantel L Graham
(74) *Attorney, Agent, or Firm* — Orrick, Herrington & Sutcliff LLP; Joseph A. Calvaruso

(57) ABSTRACT

An additive composition comprises a polymer (A) and a condensation product (B) wherein Polymer (A) comprises the following monomer components:
(i) one or more compounds of formula (I)
(ii) one or more compounds of formula (II); and
(iii) one or more compounds of formula (III);
wherein condensation product (B) comprises the product formed by the reaction of an aliphatic aldehyde or ketone, or a reactive equivalent, with a substituted phenol or mixture of substituted phenols; The weight: weight ratio of the polymer (A) to the condensation product (B) is from 1:20 to 20:1.

15 Claims, No Drawings

ADDITIVE COMPOSITIONS AND TO FUEL OILS

This invention relates to additive compositions and to fuel oil compositions with improved properties, especially, middle distillate fuels such as diesel fuels, kerosene and jet fuels and also biofuels.

In the early 1990s, concerns regarding environmental pollution prompted legislation which mandated fuel producers to produce fuels with lower sulphur contents. The sulphur content of fuels such as diesel fuel, heating oil and kerosene was successively reduced to lower and lower levels and in Europe, the maximum sulphur level mandated by the standard EN590 is now 0.001% by weight. One consequence of the refining processes employed to reduce diesel fuel sulphur and aromatic contents is a reduction in the electrical conductivity of the fuel. The insulating properties of low sulphur fuels represent a potential hazard to refiners, distributors and customers due to the potential for static charge accumulation and discharge. Static charges can occur during pumping and especially filtration of the fuel, the release of this charge accumulation as a spark constituting a significant risk in highly flammable environments. Such risks are minimised during fuel processing and handling through appropriate earthing of fuel lines and tanks combined with the use of anti-static additives. These anti-static additives do not prevent the accumulation of static charges but enhance their release to the earthed fuel lines and vessels thereby controlling the risk of sparking. A number of such additives are in common usage and are available commercially however there is a continual need for new and effective materials.

The present invention addresses the issue of the low electrical conductivity of low-sulphur content fuels by providing an additive composition which is able to increase the electrical conductivity of a fuel oil. The individual components of the additive composition interact synergistically whereby their combined effect is such that only small amounts of the composition are required to provide the required electrical conductivity to a fuel oil.

Accordingly in a first aspect, the present invention provides an additive composition comprising a polymer (A) and a condensation product (B) wherein polymer (A) comprises the following monomer components:

(i) one or more compounds of formula (I)

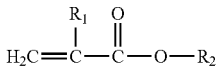

(I)

wherein $R_1$ is hydrogen or $CH_3$; and $R_2$ is a hydrocarbon group having 6 to 30 carbon atoms and is a straight-chain or branched-chain alkyl group, or an aliphatic or aromatic cyclic group;

(ii) one or more compounds of formula (II)

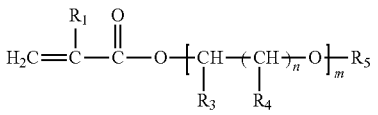

(II)

wherein $R_1$ has the meaning above and wherein $R_3$ is hydrogen or $C_1$-$C_{22}$ alkyl; each $R_4$ is independently hydrogen or $C_1$-$C_{22}$ alkyl; $R_5$ is hydrogen, a substituted or unsubstituted aliphatic or aromatic cyclic group, or a substituted or unsubstituted straight-chain or branched-chain alkyl group having 1 to 22 carbon atoms; n=0 or an integer from 1 to 22; and m is an integer from 1 to 30; and (iii) one or more compounds of formula (III)

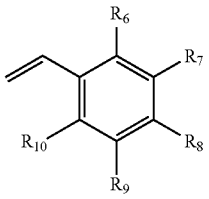

(III)

wherein $R_6$, $R_7$, $R_8$, $R_9$ and $R_{10}$ are each independently hydrogen, a straight-chain or branched-chain alkyl group having 1 to 20 carbon atoms which may be substituted or unsubstituted, hydroxyl, $NH_2$, or wherein two or more of $R_6$, $R_7$, $R_8$, $R_9$ and $R_{10}$ may together form an aliphatic or aromatic ring system, which ring system may be substituted or unsubstituted;

wherein condensation product (B) comprises the product formed by the reaction of an aliphatic aldehyde or ketone, or a reactive equivalent, with a substituted phenol or mixture of substituted phenols; and wherein the weight:weight ratio of the polymer (A) to the condensation product (B) is from 1:20 to 20:1.

The Polymer (A)

The polymer (A) is formed from at least three different monomers; a monomer of formula (I), a monomer of formula (II) and a monomer of formula (III). In a preferred embodiment the polymer (A) is formed from only three monomers. In other embodiments, the polymer (A) may comprise at least two monomer components of formula (I) and/or at least two monomer components of formula (II) and/or at least two monomer components of formula (III). If desired, other monomer components different from formulae (I), (II) and (III) may be incorporated.

Preferably $R_3$ and each $R_4$ are hydrogen.

In a preferred embodiment n=1.

In one embodiment, m is greater than 1, for example from 2 to 20.

In another embodiment, m=1.

In another embodiment, m=n=1.

Preferably, $R_5$ is hydrogen.

Preferably $R_2$ is a straight-chain alkyl group having 12 to 18 carbon atoms. Examples include n-dodecyl, n-tetradecyl, n-hexadecyl and n-octadecyl. In one preferred embodiment $R_2$ is n-dodecyl. In another preferred embodiment $R_2$ is n-octadecyl.

Preferably, $R_1$ in formula (I) and in formula (II) is $CH_3$. In this embodiment, both formula (I) and formula (II) are methacrylate monomers.

In preferred embodiments, $R_1$ in formula (I) is $CH_3$ and $R_2$ in formula (I) is a straight-chain alkyl group having 12 to 18 carbon atoms. Examples thus include n-dodecyl (or lauryl) methacrylate, n-tetradecyl methacrylate, n-hexadecyl methacrylate and n-octadecyl (or stearyl) methacrylate.

In one preferred embodiment, $R_1$ in formula (II) is $CH_3$, $R_3$, $R_4$ and $R_5$ are all hydrogen, n=1 and m is greater than 1, for example from 2 to 20. Such compounds are thus polyethylene glycol methacrylates. A preferred example is a polyethylene glycol methacrylate where the polyethylene glycol segment has a molecular weight of around 500. This corresponds to compounds of formula (II) where m is between 7 and 12, such as 9.

In another preferred embodiment, $R_1$ in formula (II) is $CH_3$, $R_3$, $R_4$ and $R_5$ are all hydrogen, n=1 and m=1. Such compounds are thus hydroxyethyl methacrylates, which may be referred to herein as HEMA.

Preferably $R_6$, $R_7$, $R_8$, $R_9$ and $R_{10}$ are each hydrogen such that formula (III) represents styrene.

Preferably monomer components of formula (I) comprise from 10-90% of the polymer expressed as mole %. More preferably monomer components of formula (I) comprise from 15-80% of the polymer expressed as mole %, for example 20-70% or 30-70% or 30-60%. If more than one monomer component of formula (I) is used, the ranges given refer to the total amount of monomers of formula (I) used.

Preferably monomer components of formula (II) comprise from 5-80% of the polymer expressed as mole %. More preferably monomer components of formula (II) comprise from 5-70% of the polymer expressed as mole %, for example 10-60% or 15-50%. If more than one monomer component of formula (II) is used, the ranges given refer to the total amount of monomers of formula (II) used.

Preferably monomer components of formula (III) comprise from 1-60% of the polymer expressed as mole %. More preferably monomer components of formula (III) comprise from 1-50% of the polymer expressed as mole %, for example 1-45% or 5-45%. If more than one monomer component of formula (III) is used, the ranges given refer to the total amount of monomers of formula (III) used.

Particular examples of polymers (A) include:

- a polymer formed from polyethylene glycol methacrylate where the polyethylene glycol segment has a molecular weight of around 500, n-dodecyl methacrylate and styrene;
- a polymer formed from polyethylene glycol methacrylate where the polyethylene glycol segment has a molecular weight of around 500, n-tetradecyl methacrylate and styrene;
- a polymer formed from polyethylene glycol methacrylate where the polyethylene glycol segment has a molecular weight of around 500, n-hexadecyl methacrylate and styrene;
- a polymer formed from polyethylene glycol methacrylate where the polyethylene glycol segment has a molecular weight of around 500, n-octadecyl methacrylate and styrene;
- a polymer formed from hydroxyethyl methacrylate, n-dodecyl methacrylate and styrene;
- a polymer formed from hydroxyethyl methacrylate, n-tetradecyl methacrylate and styrene;
- a polymer formed from hydroxyethyl methacrylate, n-hexadecyl methacrylate and styrene; and
- a polymer formed from hydroxyethyl methacrylate, n-octadecyl methacrylate and styrene.

Preferably, the polymer (A) is a statistical copolymer, more preferably a random copolymer. Those skilled in the art will be aware that the reactivity ratios of the monomers will influence the polymer architecture obtained. The monomer components (i), (ii) and (iii) used to produce the polymers have reactivity ratios of close to 1, meaning that any given monomer component is as likely to react with another monomer component of the same type as it is with a monomer component of a different type. A statistical copolymer is formed where the polymerisation follows a known statistical rule for example Bernoullian statistics or Markovian statistics. A statistical polymer where the probability of finding a particular type of monomer residue at any particular point in the polymer chain is independent of the types of surrounding monomer can be referred to as a random copolymer. Statistical and random copolymers may be distinguished from more ordered polymer types such as alternating copolymers, periodic copolymers and block copolymers.

Synthetic methods to produce the polymers will be known to those skilled in the art. The polymers may be synthesised by free-radical polymerisation using an initiator such as a peroxide or an azo-compound or by any other suitable method of initiation. One advantageous method employs Starve Feed polymerisation where the monomers and/or initiator are fed into a reactor over a controlled reaction period. This allows control over the molecular weight of the product formed and also control over the exotherm of the reaction. Standard free radical techniques are preferred but also suitable are more specialised techniques which may provide more control over polymer molecular weight and dispersity. Among these more specialised techniques there may be mentioned catalytic chain transfer polymerisation (CCTP). Others include reversible iodine transfer polymerisation (RITP), atom transfer radical polymerisation (ATRP), nitroxide mediated polymerisation (NMP), reversible addition fragmentation (RAH) polymerisation.

RAFT polymerisation uses a chain transfer agent, often a thiol such as decanethiol. The growing polymer radical terminus abstracts a hydrogen radical from a weak S—H bond of the chain transfer agent and by choosing the type and amount of agent used, polymer propagation can be terminated and hence molecular weight can be controlled.

CCTP does not require a thiol chain transfer agent, which may be advantageous in certain applications where sulphur-containing products are to be avoided, but instead employs a small amount of a more efficient chain transfer catalyst. A preferred chain transfer catalyst is a cobalt-containing complex Cobaloxime or CoBF. The preparation of this complex is described for example by A Bakač and J. H Espenson. in *J. Am. Soc* (1984), 106, 5197-5202 and by A Bakač et al. in *Inorg. Chem.*, (1986), 25, 4108-4114. The catalyst is conveniently prepared from cobalt(II) acetate tetrahydrate, dimethylglyoxime and boron trifluoride diethyl etherate. In use, the catalyst interacts with the radical at the end of the polymer chain and forms a Co(III)-H complex and a macromonomer with a terminal olefin function. The Co(III)-H complex re-initiates a new polymer chain by hydrogen transfer to a monomer thereby regenerating the Co(II) catalyst complex. Choice of the catalyst:momomer ratio allows control over polymer molecular weight and dispersity. The technique is particularly suited to the production of low molecular weight polymers.

In one embodiment, the polymer (A) used in the present invention is prepared using catalytic chain transfer polymerisation. Preferably a cobaloxime or CoBF chain transfer catalyst is employed.

Preferably the polymer (A) has a number average molecular weight (Mn) as measured by gel permeation chromatography (GPC) with reference to polystyrene standards of between 2,000 and 50,000, more preferably between 2,000 and 30,000, even more preferably between 4,000 and 25,000, for example between 4,000 and 15,000.

Preferably the polymer (A) has a dispersity (D), defined as the ratio of the weight average molecular weight (Mw) and the number average molecular weight (Mn) expressed as Mw/Mn, of from 1 to 10, more preferably from 1 to 5, for example from 1 to 3. As with Mn, Mw is measured by GPC with reference to polystyrene standards.

The Condensation Product (B)

The condensation product (B) comprises the product formed by the reaction of an aliphatic aldehyde or ketone, or a reactive equivalent, with a substituted phenol or mixture of substituted phenols.

The aldehyde may be a mono- or di-aldehyde and may contain other functional groups, such as —COOH, and these could be capable of post-reactions in the product. The aldehyde or ketone or reactive equivalent preferably contains 1-8 carbon atoms, particularly preferred are formaldehyde, acetaldehyde, propionaldehyde and butyraldehyde, most preferred is formaldehyde. Formaldehyde could be in the form of paraformaldehyde, trioxan or formalin. The term "reactive equivalent" means a material that generates an aldehyde under the conditions of the condensation reaction or a material that undergoes the required condensation reaction to produce moieties equivalent to those produced by an aldehyde. Typical reactive equivalents include oligomers or polymers of the aldehyde, acetals or aldehyde solutions.

In one embodiment, the substituted phenol comprises an ester of p-hydroxybenzoic acid or a mixture of esters of p-hydroxybenzoic acid. The condensation products made from these compounds will be referred to as HBFC (p-Hydroxy Benzoate-Formaldehyde Condensates.) Preferred are (i) a straight or branched chain $C_1$-$C_7$ alkyl ester of p-hydroxybenzoic acid, (ii) a branched chain $C_8$-$C_{16}$ alkyl ester of p-hydroxybenzoic acid, or (iii) a mixture of long chain $C_8$-$C_{18}$ alkyl esters of p-hydroxybenzoic acid, preferably where at least one of said alkyls is branched.

In preferred embodiments, the branched alkyl group is 2-ethylhexyl or isodecyl. In other embodiments, condensates of mixed n-octyl and 2-ethylhexyl esters of p-hydroxybenzoic acid may be prepared. Suitably, the molar ratio of the 2-ethylhexyl ester to the n-octyl ester is 3:1.

Preferably, the molar ratio of the branched ester to the other ester may be in the range of 5:1 to 1:5.

Other comonomers may be added to the reaction mixture of aldehyde and alkyl ester or mixture of alkyl esters. It is possible to replace up to 33 mole % of the p-hydroxybenzoic ester or ester mixture used in the condensation reaction with other comonomers in order to modify the physical properties (e.g. viscosity) of the materials whilst still retaining activity. The other comonomers comprise aromatic compounds that are sufficiently reactive to take part in the condensation reaction. They include alkylated, arylated and acylated benzenes such as toluene, xylene, biphenyls and acetophenone. Other comonomers include hydroxy aromatic compounds such as p-hydroxybenzoic acid, acid derivatives of p.-hydroxyaromatic acids such as amides and salts, other hydroxyaromatic acids, alkylphenols, naphthols, phenylphenols, acetamidophenols, alkoxyphenols and o-alkylated, o-arylated and o-acylated phenols.

HBFC are conveniently prepared by reacting 1 molecular equivalent (M.E.) of the esters of p-hydroxybenzoic acid with about 0.5-2 M.E. of the aldehyde, preferably 0.7-1.3 M.E. and more preferably 0.8-1.2 M.E. of the aldehyde. The reaction is preferably conducted in the presence of a basic or acidic catalyst, more preferably an acidic catalyst, such as p-toluenesulphonic acid. The reaction is conveniently conducted in an inert solvent, such as Exxsol D60 (a non-aromatic, hydrocarbon solvent, having a boiling point of ~200° C.), the water produced in the reaction being removed by azeotropic distillation. The reaction is typically run at a temperature of 90-200° C., preferably 100-160° C., and may or may not be run under reduced pressure.

Conveniently, HBFC can be prepared in a 2-step process whereby the esters of p-hydroxybenzoic acid are first prepared in the same reaction vessel that is used for the subsequent condensation reaction. Thus, the ester is prepared from the appropriate alcohol and p-hydroxybenzoic acid in an inert solvent using an acid catalyst such as p-toluenesulphonic acid, continuously removing water produced in the reaction. Formaldehyde is then added and the condensation reaction conducted as described above to give the desired HBFC.

In another embodiment, the substituted phenol comprises an alkyl phenol or mixture of alkyl phenols. The condensation products made from these compounds will be referred to as APFC (Alkyl-Phenol-Formaldehyde Condensates.) Preferred are ortho- and para-alkylphenols, with para-alkylphenols being particularly preferred. The alkyl radicals of the alkylphenols preferably have from 1-20 carbon atoms, more preferably 4-16 carbon atoms, for example 6-12 carbon atoms. The alkyl radicals may be linear or branched. In a preferred embodiment, the substituted phenol comprises p-nonylphenol.

APFC are conveniently prepared in the same manner as described above in relation to HBFC. Suitable as the aliphatic aldehyde or ketone, or a reactive equivalent are again those described above. Preferably the aliphatic aldehyde or ketone, or a reactive equivalent is formaldehyde.

The number average molecular weight of the polymeric condensation products is preferably in the range of 800 to 2,000, more preferably 900 to 1800.

The condensation product (B) may be represented by formula (IV)

(IV)

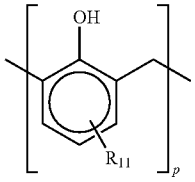

wherein in each occurrence, $R_{11}$ may be the same or different $C_1$-$C_{22}$ alkyl group or the same or different group —C(O)$OR_{12}$, wherein $R_{12}$ is a $C_1$-$C_{22}$ alkyl group; and wherein p is an integer from 2 to 10, more preferably 2 to 7, for example 3 to 6. Preferably the group $R_{11}$ is in the ortho or para position relative to the hydroxyl substituent, most preferably the group $R_{11}$ is in the para position relative to the hydroxyl substituent.

Preferably, the weight:weight ratio of the polymer (A) to the condensation product (B) in the additive composition is from 1:10 to 10:1.

If convenient, the additive composition may additionally comprise an organic liquid which acts to dissolve, solubilize or otherwise disperse the components of the additive composition. The resulting additive concentrate may be more convenient to use or store and may be easier to meter into fuel oil. Suitable organic liquids include hydrocarbon solvents such as naphtha, kerosene, diesel and heater oil, aromatic hydrocarbons such as those sold under the 'SOLVESSO' trade name, alcohols, ethers and other oxygenates and paraffinic hydrocarbons such as hexane, pentane and isoparaffins. The organic liquid should be miscible with the fuel oil in the sense that it is capable of being physically mixed with fuel oil to form either a solution or a dispersion in the fuel oil. The liquid will be chosen having regard to its compatibility with both the additive composition and the fuel oil in question, and is a matter of routine choice for one skilled in the art. The additive concentrate may suitably comprise 1 to 95% by weight of organic liquid, preferably 10 to 70%, for example 25 to 60%, the remainder being the additive composition and optionally any additional additives required to fulfill different purposes within the fuel oil. Some optional additional additives are described hereinbelow.

As discussed above, the additive compositions of the invention find utility in fuel oils. Accordingly in a second aspect, the present invention provides a fuel oil composition comprising a major amount of a fuel oil and a minor amount of an additive composition according to the first aspect.

The fuel oil may be a petroleum-based fuel oil, especially a middle distillate fuel oil. Such distillate fuel oils generally boil within the range of from 110° C. to 500° C., e.g. 150° C. to 400° C. The invention is applicable to middle distillate fuel oils of all types, including the distillates having a 90%-20% boiling temperature difference, as measured in accordance with ASTM D-86, of 50° C. or more.

The fuel oil may comprise atmospheric distillate or vacuum distillate, cracked gas oil, or a blend in any proportion of straight run and thermally and/or catalytically cracked distillates. The most common petroleum distillate fuels are kerosene, jet fuels, diesel fuels, heating oils and heavy fuel oils. The heating oil may be a straight atmospheric distillate, or may also contain vacuum gas oil or cracked gas oil or both. The fuels may also contain major or minor amounts of components derived from the Fischer-Tropsch process. Fischer-Tropsch fuels, also known as FT fuels, include those that are described as gas-to-liquid fuels, coal and/or biomass conversion fuels. To make such fuels, syngas ($CO+H_2$) is first generated and then converted to normal paraffins and olefins by a Fischer-Tropsch process. The normal paraffins may then be modified by processes such as catalytic cracking/reforming or isomerisation, hydrocracking and hydroisomerisation to yield a variety of hydrocarbons such as iso-paraffins, cyclo-paraffins and aromatic compounds. The resulting FT fuel can be used as such or in combination with other fuel components and fuel types such as those mentioned in this specification.

The invention is also applicable to fuel oils containing fatty acid alkyl esters made from oils derived from animal or vegetable materials, often called biofuels or biodiesels. Biofuels are believed by some to be less damaging to the environment on combustion and are obtained from a renewable source. Other forms of biofuels are also included in the invention such as hydrogenated vegetable oil (HVO) and oil derived from alternative sources such as algae.

Animal or vegetable sources of suitable oils are rapeseed oil, canola oil, coriander oil, soyabean oil, cottonseed oil, sunflower oil, castor oil, olive oil, peanut oil, maize oil, almond oil, palm kernel oil, coconut oil, mustard seed oil, jatropha oil, beef tallow and fish oils. Further examples include fuel oils derived from corn, jute, sesame, shea nut, ground nut and linseed oil and may be derived therefrom by methods known in the art. Rapeseed oil, which is a mixture of fatty acids partially esterified with glycerol is available in large quantities and can be obtained in a simple way by pressing from rapeseed. Recycled oils such as used kitchen oils are also suitable.

As alkyl esters of fatty acids, consideration may be given to the following, for example as commercial mixtures: the ethyl, propyl, butyl and especially methyl esters of fatty acids with 12 to 22 carbon atoms, for example of lauric acid, myristic acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid or erucic acid, which have an iodine number from 50 to 150, especially 90 to 125. Mixtures with particularly advantageous properties are those which contain mainly, i.e. to at least 50 wt % methyl esters of fatty acids with 16 to 22 carbon atoms and 1, 2 or 3 double bonds. The preferred alkyl esters of fatty acids are the methyl esters of oleic acid, linoleic acid, linolenic acid and erucic acid.

Commercial mixtures of the stated kind are obtained for example by cleavage and esterification of animal and vegetable fats and oils by their transesterification with lower (ca. $C_1$ to $C_6$) aliphatic alcohols. For production of alkyl esters of fatty acids it is advantageous to start from fats and oils which contain low levels of saturated acids, less than 20%, and which have an iodine number of less than 130. Blends of the following esters or oils are suitable, e.g. rapeseed, sunflower, canola, coriander, castor, soyabean, peanut, cotton seed, beef tallow etc. Alkyl esters of fatty acids based on certain varieties of rapeseed oil having more than 80 wt % of unsaturated fatty acids with 18 carbon atoms, are particularly suitable.

Whilst all of the above biofuels may be used as fuel oils in this invention, preferred are vegetable oil derivatives, of which particularly preferred biofuels are alkyl ester derivatives of rapeseed oil, cottonseed oil, soyabean oil, sunflower oil, olive oil, or palm oil, rapeseed oil methyl ester being especially preferred. Such fatty acid methyl esters are often referred to in the art as FAME.

Biofuels are commonly used in combination with petroleum-derived fuel oils. The present invention is also applicable to mixtures of biofuel and petroleum-derived fuels in any ratio. Such fuels are often termed "Bx" fuels where x represents the percentage by weight of biofuel in the biofuel-petroleum blend. Examples, include fuels where x is 2 or above, preferably 5 or above, for example up to 10, 25, 50, or 95. Current German legislation is framed around 'B7' biofuels. Preferably the biofuel component in such Bx base fuels comprises fatty acid alkyl esters, most preferably fatty acid methyl esters.

The invention is also applicable to pure biofuels. In one embodiment therefore, the fuel oil comprises essentially 100% by weight of a fuel derived from a plant or animal source, preferably essentially 100% by weight of fatty acid alkyl esters, most preferably fatty acid methyl esters.

Examples of jet fuels include fuels which boil in the temperature range from about 65° C. to about 330° C. and are marketed under designations such as JP-4, JP-5, JP-7, JP-8, Jet A and Jet A-1. JP-4 and JP-5 are specified in the US Military Specification MIL-T-5624-N and JP-8 in the US Military Specification MIL-T-83133-D. Jet A, Jet A-1 and Jet B are specified in ASTM D1655.

The fuel oil, whether petroleum or vegetable or animal-derived, or synthetic has a low sulphur content. Typically, the sulphur content of the fuel will be less than 500 wppm (parts per million by weight). Preferably, the sulphur content of the fuel will be less than 100 wppm, for example, less than 50 wppm, less that 20 wppm or less than 10 wppm.

In the untreated (i.e. additive-free) state, such fuel oils will normally have low electrical conductivities, usually less than 10 $pSm^{-1}$, such as around 2-5 $pSm^{-1}$.

The amount of additive composition added to the fuel oil will depend on the inherent electrical conductivity of the fuel oil and the desired target electrical conductivity to be reached. Preferably however, the additive composition is present in the fuel oil in an amount of between 5 and 1000 parts per million by weight based on the weight of the fuel oil (wppm), preferably in an amount of between 5 and 500 wppm, more preferably between 5 and 200 wppm.

In preferred embodiments, the fuel oil will contain between 10 and 500 wppm, more preferably between 20 and 200 wppm of polymer (A) and between 1 and 100, more preferably between 1 and 50 wppm of condensation product (B). For the avoidance of doubt, any and all extremes of the numerical ranges given herein for the amounts of (A) and (B) may be independently combined to create all possible combinations of ranges which are to be considered as explicitly disclosed.

As will be understood, the additive composition may be added to the fuel oil in the form of the additive concentrate described hereinabove. In this case, the amount of additive composition used or the amounts of (A) and (B) used will be with regard to their active ingredient (a.i.) content. For example the addition to a fuel oil of 200 wppm of a concentrate which contains 50% by weight of carrier fluid will provide the fuel oil with 100 wppm of additive composition.

Fuel oils containing the additive composition have higher electrical conductivities than the same fuels oils absent the additive composition. Accordingly in a third aspect, the present invention provides a method of increasing the electrical conductivity of a fuel oil, the method comprising the addition of a minor amount of an additive composition according to the first aspect to the fuel oil.

Similarly in a fourth aspect, the present invention provides the use of an additive composition according to the first aspect to increase the electrical conductivity of a fuel oil.

With regard to these aspects and as will be clear from the foregoing, the additive composition may be provided in the form of an additive concentrate, if desired.

It was found that polymers (A) alone are able to provide fuel oils with increased electrical conductivity so in a further aspect, the present invention provides the use of a polymer (A) as defined in relation to the first aspect to increase the electrical conductivity of a fuel oil.

Measurement of the electrical conductivity of a fuel oil is routine and methods to do so will be known to those skilled in the art. Commercial devices such as the Emcee™ Digital Conductivity Meter (Model 1152) are available. This device is able to measure the conductivity of a liquid sample over a range from 0 to 2000 picoSiemens per meter (pS/m) to an accuracy of 1 pS/m.

Further additives commonly added to fuel oils may also be employed together with the additive composition of this invention. Such further additives may be introduced separately into the fuel oil but are more commonly combined together in an additive concentrate as described hereinabove. Classes of additives will be known to those skilled in the art and the following examples are not intended to be an exhaustive list.

One class are additives capable of altering the low-temperature properties of fuel oils. Suitable materials are well known and include flow-improvers such as ethylene-unsaturated ester copolymers and terpolymers, for example, ethylene-vinyl acetate copolymers, ethylene-vinyl 2-ethyl hexanoate copolymers and ethylene-vinyl neodecanoate copolymers, ethylene-vinyl acetate-vinyl 2-ethyl hexanoate terpolymers, ethylene-vinyl acetate-vinyl neononanoate terpolymers, ethylene-vinyl acetate-vinyl neodecanoate terpolymers; comb polymers such as fumarate-vinyl acetate copolymers polyacrylate and polymethacrylate polymers, including those containing nitrogen or copolymerised with nitrogen-containing monomers; hydrocarbon polymers such as hydrogenated polybutadiene copolymers, ethylene/1-alkene copolymers, and similar polymers. Also suitable are additives known in the art as wax anti-settling additives (WASA).

Other classes of additives are detergents and dispersants, commonly hydrocarbyl-substituted succinimide species; cetane improvers; metal-containing additives used to improve the regeneration of particulate traps attached to the exhaust systems of some diesel engines; lubricity enhancers; other electrical conductivity improvers; dyes and other markers; and anti-oxidants. The present invention contemplates the addition of such further additives; their application in terms of treat rate being known to those skilled in the art. In a preferred embodiment the additive composition of the invention are combined with, or used in combination with, one or both of an ethylene-unsaturated ester copolymer and a wax anti-settling additive. Particularly preferred ethylene-unsaturated ester copolymers are ethylene-vinyl acetate copolymers ethylene-vinyl acetate-vinyl 2-ethyl hexanoate terpolymers, ethylene-vinyl acetate-vinyl neononanoate terpolymers and ethylene-vinyl acetate-vinyl neodecanoate terpolymers. A particularly preferred wax anti-settling additive is the amide-amine salt formed by the reaction of phthalic anhydride with two molar proportions of di-hydrogenated tallow amine.

The invention will now be described by way of non-limiting example only.

Representative Synthesis Examples

To a clean, dry Schlenk tube equipped with a magnetic stirrer was added lauryl methacrylate (9.4 g), styrene (1.6 g) and a polyethylene glycol methacrylate (7.0 g) where the polyethylene glycol segment had a molecular weight of around 500 (PEGMA500) together with AIBN (0.1 g) and butanone (40 ml). The resulting mixture was freeze-thaw degassed three times and then the tube was filled with nitrogen. The tube was then placed in a preheated aluminium heating block atop a magnetic stirrer/hotplate and a catalyst complex, CoBF (1 ml of a $1.3\times10^{-3}$ mol $dm^{-3}$ solution) was added by syringe. The reaction mixture was left stirring at 80° C. for 4 hours under positive nitrogen pressure to obtain the polymer.

For polymer A7 below, a polyethylene glycol methacrylate where the polyethylene glycol segment had a molecular weight of around 360 (PEGMA360) was used.

The same procedure was used to produce HEMA-containing polymers by substituting the polyethylene glycol methacrylate with hydroxyethyl methacrylate.

The following table details examples of polymers (A) which were synthesised as described above.

| Polymer | Percentage composition (mole %) | | | | |
|---|---|---|---|---|---|
| (A) | formula (II) | C12MA | styrene | Mn | Đ |
| A1 | $46^{(PEGMA500)}$ | 48 | 6 | 24,500 | 3.6 |
| A2 | $29^{(PEGMA500)}$ | 47 | 24 | 12,900 | 2.3 |
| A3 | $26^{(PEGMA500)}$ | 52 | 22 | 10,700 | 1.9 |
| A4 | $28^{(PEGMA500)}$ | 51 | 21 | 12,500 | 2.2 |
| A5 | $21^{(PEGMA500)}$ | 56 | 23 | 33,800 | 2.8 |
| A6 | $25^{(PEGMA500)}$ | 38 | 37 | 18,800 | 2.8 |
| A7 | $26^{(PEGMA360)}$ | 18 | 56 | 17,900 | 3.4 |
| A8 | $37^{(HEMA)}$ | 44 | 19 | 9,500 | 1.6 |

In the table, 'PEGMA500' is polyethylene glycol methacrylate monomer where the polyethylene glycol segment has a molecular weight of around 500, 'PEGMA360' is polyethylene glycol methacrylate monomer where the polyethylene glycol segment has a molecular weight of around 360 and 'HEMA' is hydroxyethyl methacrylate. These are examples of compounds of formula (H). 'C12MA' is n-dodecylmethacrylate (or lauryl methacrylate) which is a compound of formula (I); and 'styrene' is styrene, which is a compound of formula (III).

The polymers were tested for electrical conductivity in combination with two different condensation products (B). These were:

B1: an HBFC being the condensation product of formaldehyde and the iso-decyl ester of p-hydroxybenzoic acid. The product had a molecular weight (Mn) of around 1,500 g/mol.

B2: an APFC being the condensation product of formaldehyde and p-nonylphenol. The product had a molecular weight (Mn) of around 1,500 g/mol.

Electrical conductivity was measured using an Emcee™ Digital Conductivity Meter (Model 1152). Measurements were made in diesel fuel compositions containing the amounts of (A) and (B) detailed in the table below. The diesel fuel had a sulphur content of <10 ppm by weight and had an inherent electrical conductivity of ca. 5 $pS^{-1}$.

| Example | Polymer (A) | Condensation product (B) | Electrical conductivity/$pS^{-1}$ |
|---|---|---|---|
| 1 | A1 (5 wppm) | None | 52 |
| 2 | A1 (50 wppm) | None | 122 |
| 3 | A1 (100 wppm) | None | 145 |
| 4 | A2 (100 wppm) | None | 92 |
| 5 | A3 (100 wppm) | None | 210 |
| 6 | A4 (100 wppm) | None | 194 |
| 7 | A5 (100 wppm) | None | 90 |
| 8 | A6 (100 wppm) | None | 206 |
| 9 | A7 (100 wppm) | None | 95 |
| 10 | A8 (100 wppm) | None | 33 |
| 11 | None | B1 (10 wppm) | 23 |
| 12 | None | B2 (10 wppm) | 7 |
| 13 | A1 (5 wppm) | B1 (10 wppm) | 222 |
| 14 | A1 (50 wppm) | B1 (10 wppm) | 1872 |
| 15 | A2 (50 wppm) | B1 (10 wppm) | 1483 |
| 16 | A3 (50 wppm) | B1 (10 wppm) | 1059 |
| 17 | A4 (50 wppm) | B1 (10 wppm) | 901 |
| 18 | A5 (50 wppm) | B1 (10 wppm) | 1477 |
| 19 | A6 (50 wppm) | B1 (10 wppm) | 1439 |
| 20 | A1 (50 wppm) | B2 (10 wppm) | 652 |
| 21 | A1 (100 wppm) | B2 (10 wppm) | 1316 |
| 22 | A7 (50 wppm) | B1 (10 wppm) | 1328 |
| 23 | A7 (100 wppm) | B1 (10 wppm) | 1667 |
| 24 | A8 (50 wppm) | B1 (10 wppm) | 342 |
| 25 | A8 (100 wppm) | B1 (10 wppm) | 534 |

As can be seen in the table above, all polymers (A) tested were able to provide the diesel fuel with improvements in electrical conductivity when used alone (Examples 1-10). The condensation products provided the diesel fuel with either a small (B1) or not significant (B2) increase in electrical conductivity when used in an amount of lOwppm (Examples 11 & 12). The examples of the invention where both polymers (A) and condensation products (B) were used together (Examples 13-25) all provided the fuel with large increases in electrical conductivity and to levels which were significantly in excess of the sum of the individual contributions of each material when used alone. Polymers (A) and condensation products (B) clearly showed synergistic behaviour.

What is claimed is:

1. An additive composition comprising a polymer (A) and a condensation product (B) wherein polymer (A) comprises the following monomer components:

(i) one or more compounds of formula (I)

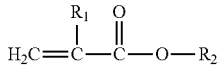

(I)

wherein $R_1$ is hydrogen or $CH_3$; and $R_2$ is a hydrocarbon group having 6 to 30 carbon atoms and is a straight-chain or branched-chain alkyl group, or an aliphatic or aromatic cyclic group;

(ii) one or more compounds of formula (II)

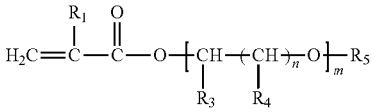

(II)

wherein $R_1$ has the meaning above and wherein $R_3$ is hydrogen or $C_1$-$C_{22}$ alkyl; each $R_4$ is independently hydrogen or $C_1$-$C_{22}$ alkyl; $R_5$ is hydrogen, a substituted or unsubstituted aliphatic or aromatic cyclic group, or a substituted or unsubstituted straight-chain or branched-chain alkyl group having 1 to 22 carbon atoms; n=0 or an integer from 1 to 22; and m is an integer from 1 to 30; and (iii) one or more compounds of formula (III)

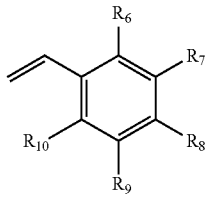

(III)

wherein $R_6$, $R_7$, $R_8$, $R_9$ and $R_{10}$ are each independently hydrogen, a straight-chain or branched-chain alkyl group having 1 to 20 carbon atoms, hydroxyl, or wherein two or more of $R_6$, $R_7$, $R_8$, $R_9$ and $R_{10}$ may together form an aliphatic or aromatic ring system, wherein the compounds of formula (III) does not contain nitrogen;

wherein condensation product (B) comprises the product formed by the reaction of an aliphatic aldehyde or ketone, or a reactive equivalent, with a substituted phenol or mixture of substituted phenols; and wherein the weight:weight ratio of the polymer (A) to the condensation product (B) is from 1:20 to 20:1.

2. An additive composition according to claim 1 wherein $R_3$ and each $R_4$ are hydrogen.

3. An additive composition according to claim 1 or claim 2 wherein n=1.

4. An additive composition according to claim 1 wherein $R_2$ is a straight-chain alkyl group having 12 to 18 carbon atoms.

5. An additive composition according to claim 1 wherein $R_1$ in formula (I) and in formula (II) is $CH_3$.

6. An additive composition according to claim 1 wherein $R_6$, $R_7$, $R_8$, $R_9$ and $R_{10}$ are each hydrogen.

7. An additive composition according to claim 1 wherein the condensation product (B) is of formula (IV)

(IV)

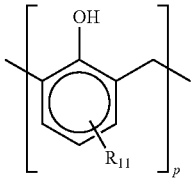

wherein in each occurrence, $R_{11}$ may be the same or different $C_1$-$C_{22}$ alkyl group or the same or different group —C(O)$OR_{12}$, wherein $R_{12}$ is a $C_1$-$C_{22}$ alkyl group; and wherein p is an integer from 2 to 10.

8. An additive composition according to claim 1 additionally comprising an organic liquid.

9. A fuel oil composition comprising a major amount of a fuel oil and a minor amount of an additive composition according to claim 1.

10. A fuel oil composition according to claim 9 wherein the additive composition is present in the fuel oil in an amount of between 5 and 1000 parts per million by weight based on the weight of the fuel oil (wppm).

11. A fuel oil composition according to claim 10 wherein the additive composition is present in the fuel oil in an amount of between 5 and 500 parts per million by weight based on the weight of the fuel oil (wppm).

12. A fuel oil composition according to claim 11 wherein the additive composition is present in the fuel oil in an amount of between 5 and 200 parts per million by weight based on the weight of the fuel oil (wppm).

13. A method of increasing the electrical conductivity of a fuel oil, the method comprising the addition of a minor amount of an additive composition according to claim 1 to the fuel oil.

14. A fuel oil composition according to claim 9 wherein the additive composition is present in the fuel oil in an amount of between 10 and 500 parts per million by weight based on the weight of the fuel oil (wppm).

15. A fuel oil composition according to claim 14 wherein the additive composition is present in the fuel oil in an amount of between 20 and 200 parts per million by weight based on the weight of the fuel oil (wppm).

* * * * *